US009199252B2

(12) United States Patent
Schorn et al.

(10) Patent No.: US 9,199,252 B2
(45) Date of Patent: Dec. 1, 2015

(54) SHOWER DEVICE

(71) Applicant: Hansgrohe SE, Schiltach (DE)

(72) Inventors: Franz Schorn, Schiltach (DE); Klaus Butzke, Schiltach (DE); Markus Wöhrle, Schiltach (DE); Fabian Melle, Ortenberg (DE); Juergen Buehler, Schiltach (DE); Sven Kleinwaechter, Steinach (DE)

(73) Assignee: Hansgrohe SE, Schiltach (DE)

( * ) Notice: Subject to any disclaimer, the term of this patent is extended or adjusted under 35 U.S.C. 154(b) by 247 days.

(21) Appl. No.: 13/938,407

(22) Filed: Jul. 10, 2013

(65) Prior Publication Data

US 2014/0014743 A1 Jan. 16, 2014

(30) Foreign Application Priority Data

Jul. 13, 2012 (DE) ..... 10 2012 212 300

(51) Int. Cl.

| | |
|---|---|
| ***B05B 7/02*** | (2006.01) |
| ***B05B 1/16*** | (2006.01) |
| ***B05B 1/30*** | (2006.01) |
| ***B05B 1/18*** | (2006.01) |

(52) U.S. Cl.

CPC ..... *B05B 1/16* (2013.01); *B05B 1/1609* (2013.01); *B05B 1/1636* (2013.01); *B05B 1/1681* (2013.01); *B05B 1/18* (2013.01); *B05B 1/3006* (2013.01)

(58) Field of Classification Search

CPC ..... B05B 1/16; B05B 1/18; B05B 1/1681; B05B 1/1609; B05B 1/3006; B05B 1/16361

USPC ..... 239/443, 444, 446, 556, 557, 559–561, 239/562, 525, 530

See application file for complete search history.

(56) References Cited

U.S. PATENT DOCUMENTS

| | | | | |
|---|---|---|---|---|
| 7,100,845 | B1 * | 9/2006 | Hsieh | 239/559 |
| 7,918,408 | B2 * | 4/2011 | Tshieh | 239/444 |
| 8,066,203 | B2 * | 11/2011 | Zhou | 239/443 |
| 2009/0289129 | A1 | 11/2009 | Qiu | |

FOREIGN PATENT DOCUMENTS

| | | | |
|---|---|---|---|
| DE | 202009015042 | U1 | 7/2010 |
| GB | 2270859 | A1 | 3/1994 |

OTHER PUBLICATIONS

Office Action dated Mar. 4, 2013 in DE application 10 2012 212 300.8.

Search report dated Oct. 29, 2013 in EPO application 13174601.8.

* cited by examiner

*Primary Examiner* — Steven J Ganey

(74) *Attorney, Agent, or Firm* — Duane Morris LLP

(57) ABSTRACT

A shower device according to the invention includes a shower head housing having a jet disk and a multiplicity of jet outlet openings. The jet outlet openings are divided into multiple groups of jet outlet openings. For each group of jet outlet openings, a distinct chamber is formed in the shower head housing. A water inlet can for example be connected by means of a change-over valve to in each case one of the chambers fluidic in parallel. The two chambers are arranged consecutively in the shower head housing. The water exiting the rear chamber as viewed relative to the jet disk can for example pass through the front chamber in a sealed channel or as a jet, which passes through a larger opening of the jet disk.

13 Claims, 5 Drawing Sheets

SHOWER DEVICE

The invention relates to a shower device, for example a hand-held shower device or an overhead shower device.

Shower devices are already known which comprise a multiplicity of jet outlet openings in their jet disk, through which openings e.g. two different jets can be discharged, like hard or soft jets. A change-over device to be operated manually allows to switch between the two jet types.

For example, the jet outlet openings are arranged in concentric rings, wherein the different jet types are grouped together such that one ring discharges one type of jets and the next ring discharges the other type of jets. In order to achieve that, annular chambers are arranged behind the jet disk, which in each case extend up to the back side of the jet disk. Thus, this is a side-by-side chamber arrangement.

In a known shower head of said type (GB 2 270 859 A), the jet disk comprises a plurality of concentric, annular rings of jet outlet openings. The outer ring delivers ventilated jets, and an inner ring discharges massage jets.

Such an arrangement of shower jets also results in a change of the jet pattern when switching between the different jet types, since in one case the jets are discharged in the region of the circumference of the shower head, while after the switching, said jets are only discharged in the center of the shower head.

The utility model publication DE 20 2009 015 042 U1 discloses a shower head of a similar type, where a first water chamber having an associated set of first water outlets is separated from a second water chamber with an associated set of second water outlets by means of an annular partition wall. A water diversion element is connected upstream of the two water chambers that are adjacent to a jet outlet disk by means of their water outlets. The diversion element comprises two water diversion openings, where by switching one of which can in each case be opened and the other one be closed and vice versa, in order to feed water, that was fed via an inlet channel into a pre-chamber upstream of the water diversion openings, to the first or to the second water chamber in a switching manner.

It is an object of the invention to provide a shower device where the discharge jets can be distributed most uniformly over the entire discharge area of the jet disk, so that in the case there is a possibility to change-over between the different jets, the overall appearance is changed as little as possible.

To achieve said object, the invention proposes a shower device comprising a shower head housing which comprises a jet disk having a multiplicity of jet outlet openings, which form a plurality of groups of jet outlet openings, a water conduit from a water inlet into the shower head housing, and at least two chambers formed in the shower head housing which are fluidly coupled in parallel to the water inlet via the water conduit and of which chambers at least one chamber is exclusively for the water supply to one of the plurality of groups of jet outlet openings and each chamber is for the water supply to at least one of the plurality of groups of jet outlet openings, wherein the two chambers are arranged consecutively behind the jet disk in the shower head housing.

Further embodiments of the invention are the subject-matter of the dependent claims. The shower device can be a hand-held shower device, an overhead shower device or also a side shower device.

Thus, the shower head housing includes at least two chambers responsible for water supply to the jet outlet openings. At least one of said two chambers is responsible for the water supply to exclusively one group of jet outlet openings in the jet disk.

The consecutive arrangement of the two chambers provides the advantage of little effort being involved in the production of the shower head housing, and that it is therefore feasible in a relatively simple way to distribute the associated discharge jets uniformly over the outlet area of the jet disk.

In the case that only one of said chambers is responsible for the water supply of exclusively one group of jet outlet openings, the other chamber may supply both groups of jet outlet openings with water.

In a further development of the invention, it can be provided that both chambers are responsible for the water supply of in each case exclusively one group of jet outlet openings.

In the case of a consecutive arrangement of two water supply chambers, it is appropriate and proposed by the invention that one chamber is arranged immediately behind the jet disk so that a group of jet outlet openings directly leads into said chamber arranged behind said jet disk and thus said chamber is to be referred to as front chamber.

It is appropriate that the rear chamber is arranged immediately behind the front chamber, that is to say only separated from the front chamber by a partition wall, so as to allow a simple construction.

In particular in this case, it can be provided according to the invention that the jet outlet openings of a group of jet outlet openings communicate with the rear chamber via channels, which pass through the front chamber. Thus, the water exits the shower from the rear chamber through in each case one distinct channel for each jet outlet opening.

Another option can be that the rear chamber comprises distinct jet outlet openings which are arranged concentrically relative to jet outlet openings of the jet disk, and have a smaller diameter. Thus, the water exiting the rear chamber exits in the form of individual jets, which pass through the front chamber and exit in each case only through those jet outlet openings that are assigned to the rear chamber.

According to the invention, in a further embodiment, the shower device can comprise a manually operable change-over valve used to connect in each case one of the two chambers to the water inlet into the shower head housing. Thus, as a result, there can be a change-over between the different water jets, what is particularly appropriate in the case that different types of water jets are involved.

However, it is also possible to configure the change-over valve such that it also includes the option of supplying water to both chambers at the same time. Such an option is appropriate even in the case that both groups of jet outlet openings discharge the same type of water jets. That way the amount of water to be discharged can be controlled to a certain extent.

According to the invention, it can be provided that the jet outlet openings of both groups of jet outlet openings are arranged in the jet disk in a mixed manner or in a uniformly distributed manner.

According to the invention, it can be provided that the jet outlet openings of both groups of jet outlet openings are identical, in particular in the case when the change-over valve is to be used such that a change-over is made between the supply of one group on the one hand and the supply of both groups at the same time on the other hand. Then, the supply of only one group of jet outlet openings can be considered to be an economy change-over state.

Another option is that the jet outlet openings of both groups are configured for a discharge of different types of jets.

According to the invention it can be provided that the jet outlet openings of one group are identical to one another or that they deliver the same type of jets.

In order to allow a simple structure, it can be provided in a further embodiment according to the invention that the jet outlet openings, preferably of both groups, are formed by nipples made of elastomer material, which are molded to a common plate made of said material and abutting the inner face of the jet disk. Preferably, the nipples protrude to a certain extent from the jet disk on the front side.

According to the invention, in a further embodiment it can be provided that said nipples are extended within the first chamber on the backside of the plate abutting the jet disk and that they form a neck there.

According to the invention, in a further development it can be provided that necks molded to a partition wall between the two chambers engage into the nipples that optionally may also be extended on their inner side, where said necks forming the channels through which the water gets from the rear chamber to the jet outlet openings of the jet disk.

According to the invention, the shower head housing may, for example at its center, comprise a device for the formation of massage jets, which device includes another chamber for the supply of water.

Further features, details and advantages of the invention arise from the claims, the wording of which is incorporated into the content of the description by reference, and from the following description of advantageous embodiments of the invention as well as from the drawings, in which:

Figures 1, 2:
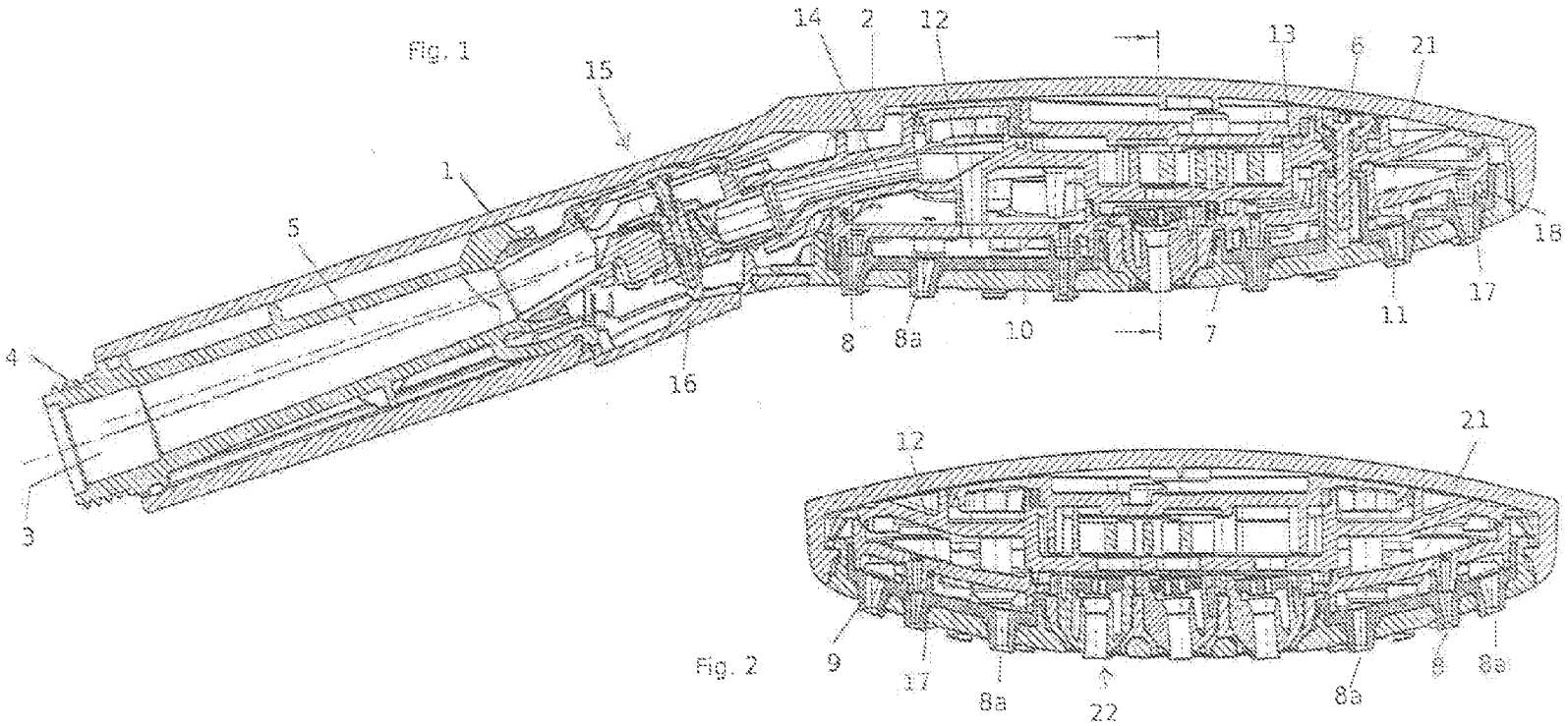
FIG. 1 is a longitudinal sectional view of a hand-held shower device according to the invention.
FIG. 2 is a cross-sectional view through a shower head housing of FIG. 1.

FIG. 1 shows a longitudinal section through a hand-held shower device. The hand-held shower device includes a handle 1 which is attached to a shower head housing 2. At the end of the handle 1, there is a water inlet 3. A union nut of a shower hose can be screwed onto an external thread 4 of a channel 5.

The shower head housing 2 includes a rear wall 6 and a jet disk 7 opposite thereto. In the jet disk 7, there is a multiplicity of jet outlet openings 8 and 8*a*, that are formed by nipples 9, 17 made of elastomer material. The nipples 9, 17 are molded to a flat element 10 that abuts the internal surface of the jet disk 7. The nipples 9, 17 slightly protrude beyond the external surface of the jet disk 7, that is to say they are slightly sticking out. Said nipples include a passage 11 in the interior thereof.

The openings 8 and 8*a* are uniformly distributed over the entire surface of the jet disk, wherein the openings 8 correspond to the nipples 9 and the openings 8*a* correspond to the nipples 17.

Immediately behind the plate 10 made from elastomer material and abutting the jet disk 7, a first chamber 12 is formed from which the nipples 9 lead out. The chamber 12 is limited by a partition wall 13 extending approximately parallel to the jet disk 7. A water conduct through a channel 14 leads into the chamber 12. Between the channel 5 connecting to the inlet 3 into the shower head housing 2 and the channel 14, a change-over valve 15 is arranged, which is operated by means of a key 16. The key 16 is arranged in the transition region between the handle 1 and the jet disk 7, so that a user can operate said key with the thumb of the hand that holds the shower device.

In the position of the change-over valve 15 shown in FIG. 1 the water conduit 5, 14 is connected to the aforementioned chamber 12. Thus, the water flowing into the shower gets from the jet outlet openings 8*a* of said chamber 12 into the region in front of the jet disk 7.

Besides the nipples 9, as mentioned above, the nipples 17 project from the jet disk 7, which nipples 17 in contrast to the nipples 9 form an extension 18 on the back side of the plate 10 facing away from the jet disk 7. Necks 19 engage into said extension 18, which necks are molded to the partition wall 13 and which have continuous openings. Behind the partition wall 13, another chamber 21 is formed, which depending on the position of the change-over valve 15 can also be in communication with the water conduit. In the case that the chamber 21 is connected to the inlet 3, the water gets from the second chamber 21 via the necks 19 into the nipples 17 and then exits through said nipples 17 or the associated openings 8 out of the jet disk 7.

In FIG. 2, said second chamber 21 can also be seen, as well as the different types of nipples 9 or 17.

In the center of the jet disk, several means 22 for discharging massage jets are arranged.

Figure 3:
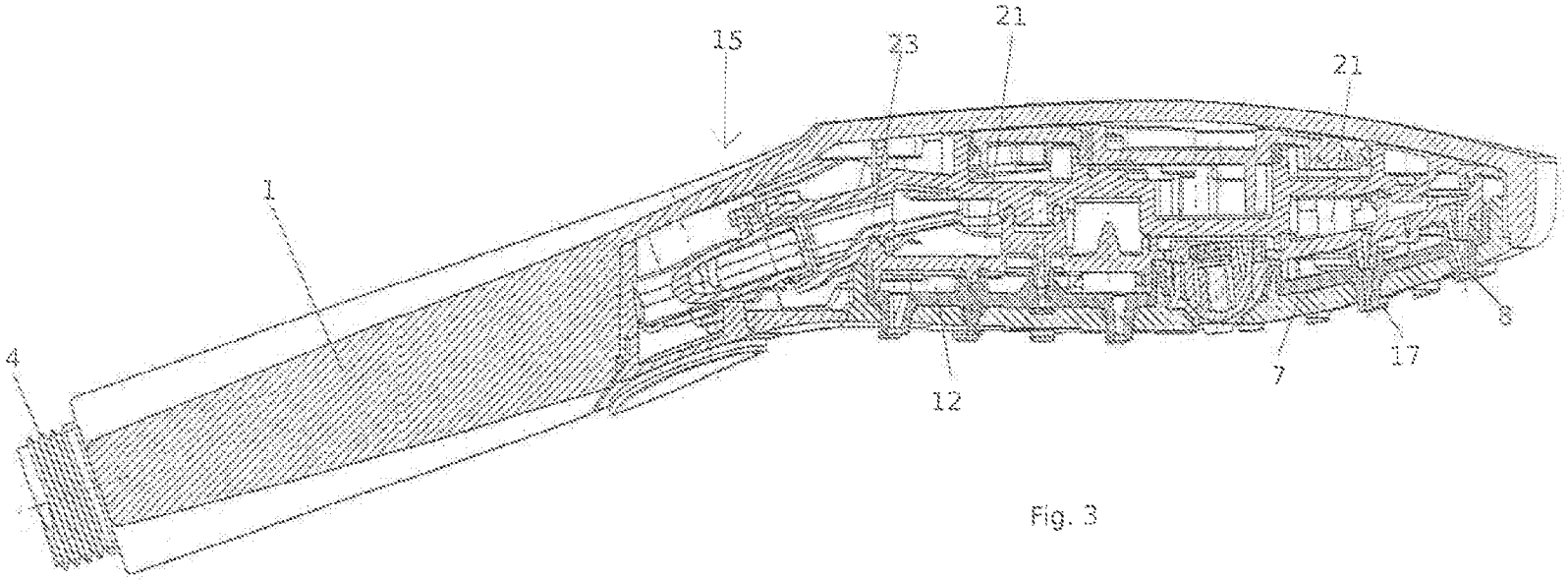
FIG. 3 is a section according to FIG. 1 in another plane.

FIG. 3 shows a section where the water conduit is in communication with the rear chamber 21 via a section 23. Thus, in said position of the change-over valve 15, the water exits exclusively through the nipples 17 connected to the rear chamber 21. The front chamber 12 is not in communication with the water inlet 3, so that water does not exit from the jet outlet openings 8*a* assigned to the front chamber.

In the case of the embodiment of the shower device according to the invention shown in FIGS. 1 to 3, the jet outlet openings 8*a*, 8 are in each case assigned to only one chamber and 21, respectively. Thus, each jet outlet opening is assigned either to the front chamber 12, that is to say the chamber that is arranged closer to the jet disk 7, or to the rear chamber 21, which is separated from the front chamber by the partition wall 13. In this case, the chambers 12, 21 are fluidly coupled in parallel to the water inlet 3 via the water conduit.

Figure 4:
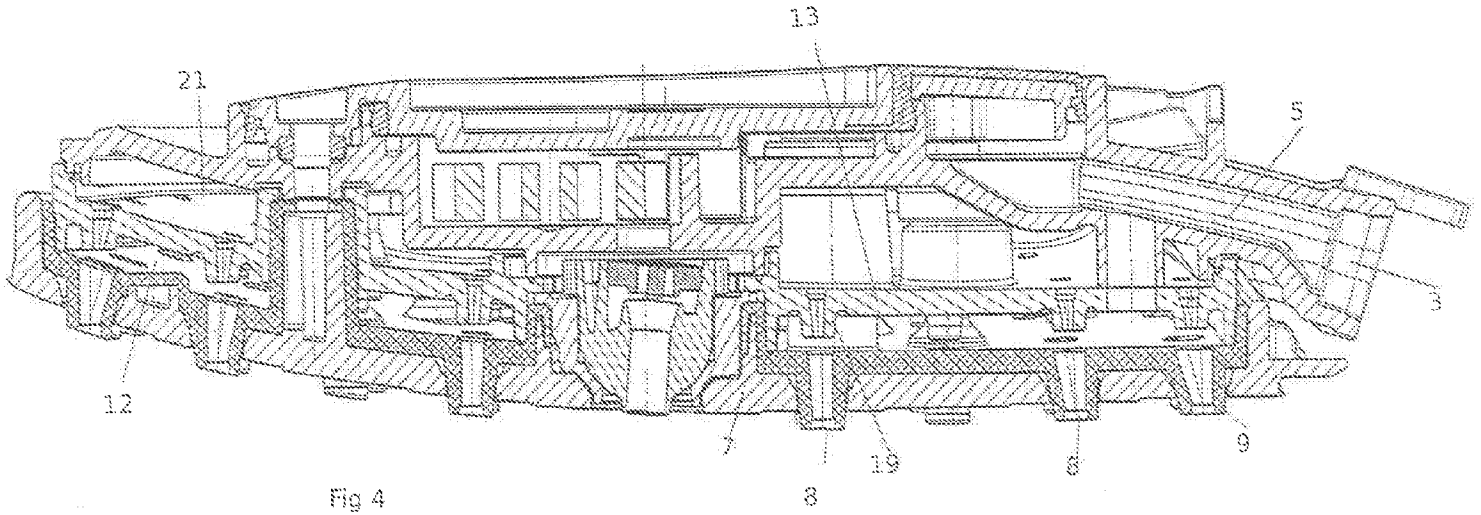
FIG. 4 is a section through the shower head housing in a first position of a change-over operation.
Figure 5:
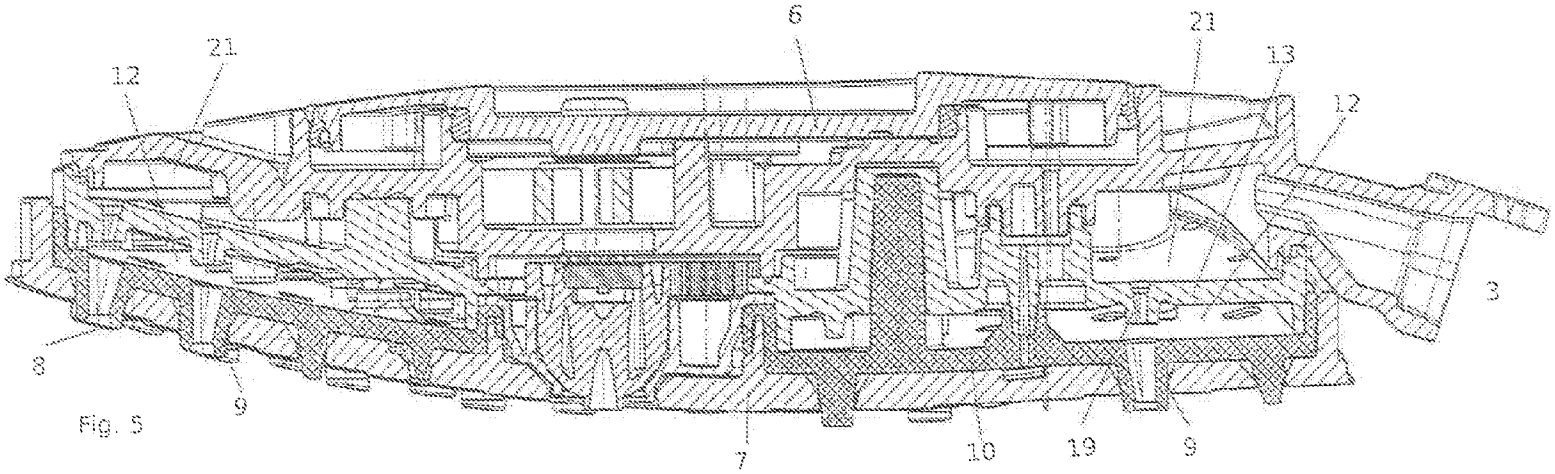
FIG. 5 is a section according to FIG. 4 in another plane.

FIGS. 4 and 5 show a modified embodiment.

As in the above embodiment, the shower head housing comprises a jet disk 7 and a rear wall 6. A planar element 10 made from elastomer material abuts the inner side of the jet disk 7, to which element nipples 9 are molded to. Said nipples 9 form the jet outlet openings 8. On the inner side of the element 10, all nipples 9 extend flush with the latter. Behind the jet disk 7, the first chamber 12 is formed, which is limited by the partition wall 13. Behind the partition wall 13, the second chamber 21 is formed. On the front side of the partition wall 13, short necks 19 are ending, however, they end within the chamber 12.

The necks 19 form jet outlet openings from the rear chamber 21 which are aligned relative to the nipples 9, so that jets exiting from the rear chamber 21 can get to the exterior through the nipples 9. Furthermore, the chambers 12, 21 are fluidly coupled to the water conduit via the change-over valve in parallel.

In the case that the water guidance is set by means of the change-over valve such that the front chamber 12 is connected to the inlet 3, jets exit from all jet outlet openings 8. This is illustrated in FIG. 4. In contrast, if the change-over valve is set such that the inlet 3 is connected to the rear chamber 21, jets only exit from those jet outlet openings 8 behind which the necks 19 of the partition wall 13 from the second chamber 21 are arranged. This is shown in FIG. 5.

Figure 6:
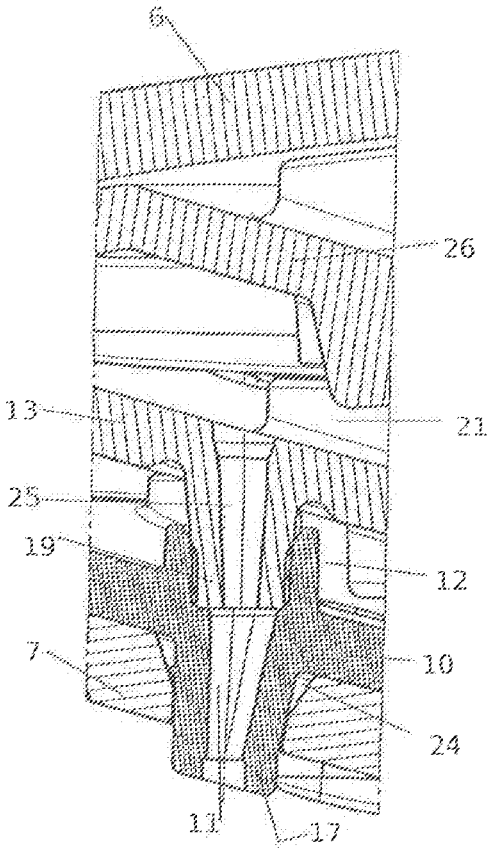
FIG. 6 is a partial section through a jet outlet opening in enlarged scale.

The interaction of the nipples 17 and the necks 19 of the partition wall 13, to which reference was made in FIG. 1 and in FIG. 2, can be seen in more detail in FIG. 6. Behind the jet disk 7, the partition wall 13 extends approximately in parallel. Between said disk and said wall, the front chamber 12 is formed. The jet disk 7 comprises holes 24. The nipples 9 or 17 engage through the holes 24. Since the nipples 9 or 17 are made of elastomer material, they seal the holes 24 at the same time, so that water can exit from the first chamber 12 only through the nipples 9. The mat 10 made of elastomer material abuts planarly on the internal surface of the jet disk 7. The nipples 17 have a neck 18 as a rear-sided extension of the nipples 17 on the internal surface of the mat 10.

On the front side of the partition wall 13, necks 19 are formed, which form a channel 25. The necks 19 engage into the rear-sided extension 18 of the nipples 17. Said necks abut the inner side of the extension 18 under tension, so that by means of the material of the extension 18, a sealing is also effected here.

Behind the partition wall 13, the second chamber 21 is formed, which is terminated by means of a component 26 of the shower head housing.

When assembling the shower head housing, initially the mat 10 including the nipples 9, 17 is placed on the inner surface of the jet disk 17. After that, the partition wall 13 is attached from the back side and inserted into the rear-sided extension 18 of the nipples 17 together with the necks 19.

Figure 7:
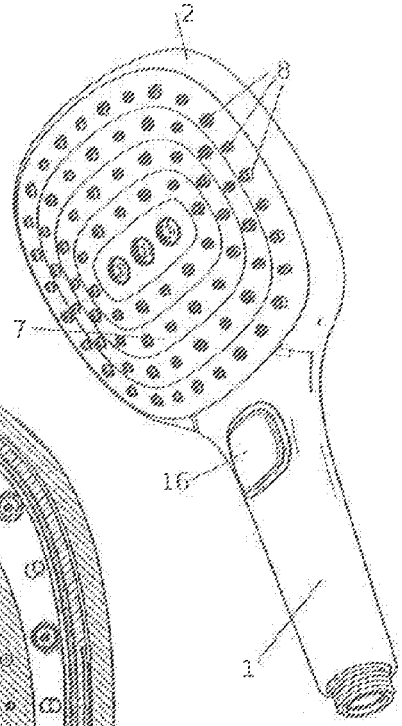
FIG. 7 is a perspective view of a hand-held shower device.

FIG. 7 shows a perspective view of a hand-held shower device including a handle 1, a jet disk 7 and the shower head housing 2. The jet outlet openings 8 and 8*a* are arranged in multiple nested rings. The consecutive arrangement of the two chambers 12 and 21, one behind the other, allows that within each ring, the nipples 9 and 17 are alternating. In the case of the embodiment of FIGS. 4 and 5, the nipples 9 with a neck 19 arranged behind and those nipples 9 without such a neck, may also be alternately arranged. That way it is possible to distribute the different jet types, for which the two chambers 12, 21 that are arranged fluidic in parallel are responsible, most uniformly over the entire area of the jet disk.

Figure 8:
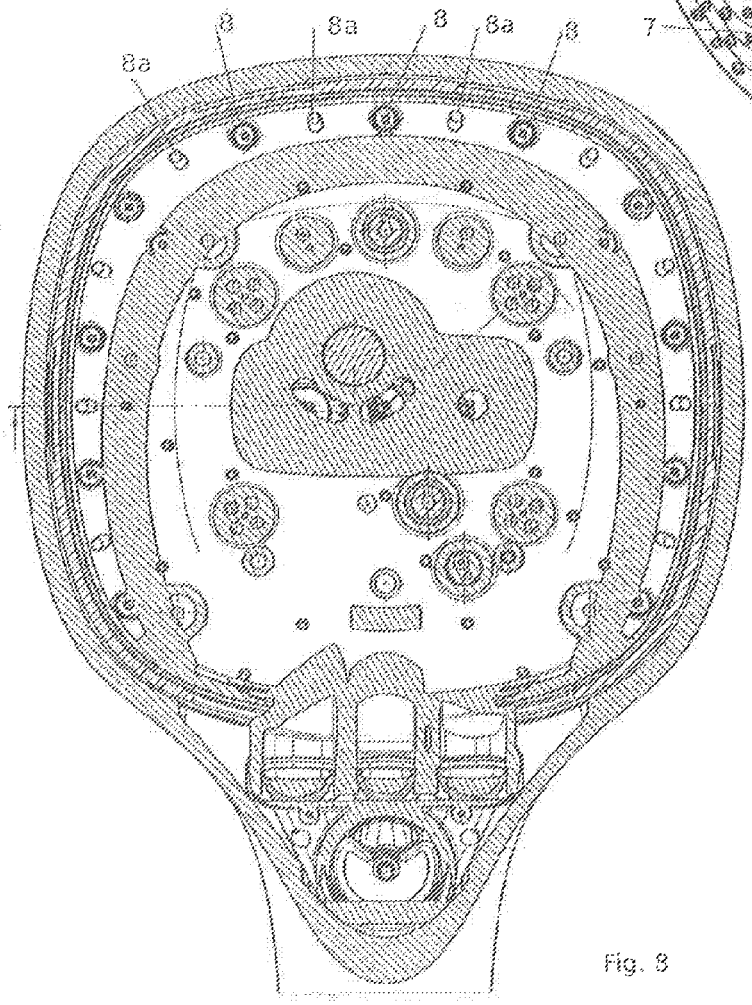
FIG. 8 is a section through the hand-held shower device of FIG. 8 in a plane parallel to the jet disk.

The section of FIG. 8, for example, shows the alternation of different nipples 9, 17 on the outer ring of jet outlet openings 8 and 8*a*.

The invention claimed is:

1. A shower device comprising a shower head housing which comprises a jet disk having a multiplicity of jet outlet opening, which form a plurality of groups of jet outlet openings, a water conduit from a water inlet into the shower head housing, and at least two chambers formed in the shower head housing which are fluidly coupled in parallel to the water inlet via the water conduit and of which chambers at least one chamber is exclusively for the water supply to one of the plurality of groups of jet outlet openings and each chamber is for the water supply to at least one of the plurality of groups of jet outlet openings, wherein the two chambers are arranged consecutively, one behind the other and behind the jet disk in the shower head housing.

2. The shower device according to claim 1, wherein each of the two chambers is exclusively for the water supply to in each case one group of jet outlet openings.

3. The shower device according to claim 1, wherein the jet outlet openings of at least one of the plurality of groups of jet outlet openings directly lead into the front chamber relative to the jet disk.

4. The shower device according to claim 1, wherein the jet outlet openings of at least one of the plurality of groups of jet outlet openings lead through channels that pass through the front chamber as viewed relative to the jet disk into the rear chamber as viewed relative to the jet disk.

5. The shower device according to claim 1, wherein the rear chamber as viewed relative to the jet disk comprises distinct jet outlet openings which lead into the front chamber as viewed relative to the jet disk, are aligned relative to the jet outlet openings leading out of the front chamber, and have a smaller diameter than the latter openings.

6. The shower device according to claim 5, wherein the jets with the smaller diameter exit from the openings with the larger diameter.

7. The shower device according to claim 1, comprising a manually operable change-over valve for connecting in each case one chamber to the water inlet.

8. The shower device according to claim 1, wherein the jet outlet openings of the two groups are arranged in a mixed manner or are distributed in a uniform manner in the jet disk.

9. The shower device according to claim 1, wherein the jet outlet openings of the two groups are identical.

10. The shower device according to claim 1, wherein the jet outlet openings of the two groups are configured for discharging different jet types.

11. The shower device according to claim 1, wherein the jet outlet openings are formed by nipples which are made from elastomer material and molded to a common plate abutting the inner face of the jet disk.

12. The shower device according to claim 11, wherein necks molded to the partition wall between the two chambers engage into the nipples for formation of channels.

13. The shower device according to claim 1, comprising another chamber for supplying water to a means for formation of massage jets.

* * * * *